US007699592B2

(12) United States Patent
Arnold

(10) Patent No.: US 7,699,592 B2
(45) Date of Patent: Apr. 20, 2010

(54) ROTARY PISTON MACHINE

(75) Inventor: Felix Arnold, Stuttgart (DE)

(73) Assignee: Cor Pumps + Compressors AG, Stuttgart (DE)

( * ) Notice: Subject to any disclaimer, the term of this patent is extended or adjusted under 35 U.S.C. 154(b) by 0 days.

(21) Appl. No.: 11/885,305

(22) PCT Filed: Mar. 16, 2006

(86) PCT No.: PCT/DE2006/000478

§ 371 (c)(1),
(2), (4) Date: Sep. 20, 2007

(87) PCT Pub. No.: WO2006/097092

PCT Pub. Date: Sep. 21, 2006

(65) Prior Publication Data

US 2008/0219876 A1 Sep. 11, 2008

(30) Foreign Application Priority Data

Mar. 16, 2005 (DE) ..... 10 2005 012 511

(51) Int. Cl.
*F03C 2/00* (2006.01)
*F04C 18/00* (2006.01)

(52) U.S. Cl. ..... 418/195; 418/68; 418/71

(58) Field of Classification Search ..... 418/68, 418/195, 71, 95
See application file for complete search history.

(56) References Cited

U.S. PATENT DOCUMENTS

| | | | | |
|---|---|---|---|---|
| 324,246 | A * | 8/1885 | Fielding | 418/68 |
| 739,207 | A * | 9/1903 | Nielsen | 418/195 |
| 2,016,605 | A * | 10/1935 | Kempthorne | 418/68 |
| 2,040,178 | A * | 5/1936 | Kempthorne | 418/68 |
| 2,375,923 | A * | 5/1945 | Johnson | 418/68 |
| 2,501,998 | A * | 3/1950 | Dutrey | 418/68 |
| 3,040,664 | A * | 6/1962 | Hartley | 418/195 |
| 3,101,700 | A * | 8/1963 | Bowdish | 418/195 |
| 3,816,039 | A * | 6/1974 | Berry | 418/68 |
| 5,145,348 | A | 9/1992 | Zumbusch | |
| 5,425,625 | A | 6/1995 | Hsu | |
| 7,275,920 | B2 * | 10/2007 | Arnold | 418/195 |
| 7,390,181 | B2 * | 6/2008 | Arnold | 418/195 |
| 2001/0031215 | A1 * | 10/2001 | Klassen | 418/195 |
| 2002/0094293 | A1 * | 7/2002 | Klassen | 418/195 |
| 2005/0175493 | A1 | 8/2005 | Arnold | |
| 2006/0257277 | A1 | 11/2006 | Arnold | |
| 2006/0263228 | A1 | 11/2006 | Arnold | |
| 2007/0253851 | A1 * | 11/2007 | Arnold | 418/21 |

FOREIGN PATENT DOCUMENTS

| | | |
|---|---|---|
| DE | 103 35 939 | 4/2004 |
| DE | 10 2004 044 297 | 5/2005 |
| WO | WO-2005/024236 | 3/2005 |
| WO | WO-2005/024237 | 3/2005 |

* cited by examiner

*Primary Examiner*—Thomas E Denion
*Assistant Examiner*—Mary A Davis
(74) *Attorney, Agent, or Firm*—Jordan and Hamburg LLP

(57) ABSTRACT

A rotary piston machine includes a driving part driven by an electric motor, and a driven part that have mutually engaging end-face denticulation for delivering a medium, the driving part and the driven part being housed in a machine housing and connected to the machine housing via respective bottom bearings of the driving/driven parts, creating a unit.

8 Claims, 1 Drawing Sheet

22
14
18
4
13
16
3
11
17
9
10
6
2
3
7
27
II
II
28
25
28
24
26
1
12
15
17
20
5
8

18
19
12
11
17
10
I
I
22
13
16
15
9

20
23
17
III
21
23

17
20
23
21

ROTARY PISTON MACHINE

BACKGROUND OF THE INVENTION

The invention proceeds from a rotary piston machine having end-face denticulation in a driving part and in a driven part and having, disposed between the denticulation, working spaces that increase and decrease in size during the rotation producing the delivery action of the medium, is described in the (older) patent application 10 2004 044 297 A1, which was not pre-published.

The underlying object of the invention is to improve the rotary piston machine such that it can be produced in a particularly favorable manner without sacrificing the advantages described in the available, older application.

SUMMARY OF THE INVENTION

The rotary piston machine according to the invention has special advantages compared to the aforementioned rotary piston machine. Because of the fact that the driving part and the driven part are arranged within the machine housing and are enclosed by the bottom bearing, it is possible to adjust the clearance retroactively, down to a basic setting, and it is also possible to suppress a subsequent clamping of the running parts, because there is a unit between the bottom bearing and machine housing. Thus, a required axial clearance is retained.

In accordance with one advantageous embodiment of the invention, for fixing it in the machine housing, the radial edge area of the bottom bearing can be screwed or glued or pressed into a corresponding end-face opening in the machine housing, so that the bottom bearing can be attached to the machine housing in very different manners. What is critical is that a unit is attained.

For favorable running of the rotors, in accordance with one embodiment of the invention the driving part and/or the driven part has a journal on the side facing away from the pump space, and the bottom bearing has an annular central bearing bore for receiving the journal. According to additional embodiments of the invention, the machine housing embodied as a unit can be admitted into a pump housing that can be closed on the end-face facing away from the electric motor, whereby the pump housing can be embodied in the shape of a pot with a bottom that runs on an incline to a center axis for supporting the bottom bearing of the driven part.

In accordance with the invention, the space in front of at least one of the driving/driven parts on the side facing away from the pump working space can be connected hydraulically to the pressure side of the pump working space, so that the rotors can be loaded in opposition to one another, whereby bores or channels in the machine housing can provide the hydraulic connection.

Another embodiment of the invention, a clearance-equalizing catch coupling that is arranged between the shaft end of the electric motor and the driving part, whereby the catch coupling is embodied as an annular/plug-in part having a profiled interior recess for engaging the shaft end of the electric motor and also having an insertion journal for engaging in corresponding openings on the side of the driving part that faces away from the pump space. Such clearance-equalizing catch couplings are known per se, but are novel for a rotary piston machine of the type claimed. Above all, motor conditions are now decoupled from the pump and, vice versa, pump singularities are decoupled from the motor, by means of this clearance-equalizing catch coupling. Decoupling the drive is significant especially by creating a unit between pump parts and machine housing.

Additional advantages and advantageous embodiments of the invention can be taken from the following description, drawings, and the claims.

The drawings depict one exemplary embodiment of the subject of the invention and it is described in greater detail in the following.

DETAILED DESCRIPTION OF THE INVENTION

Figure 1:
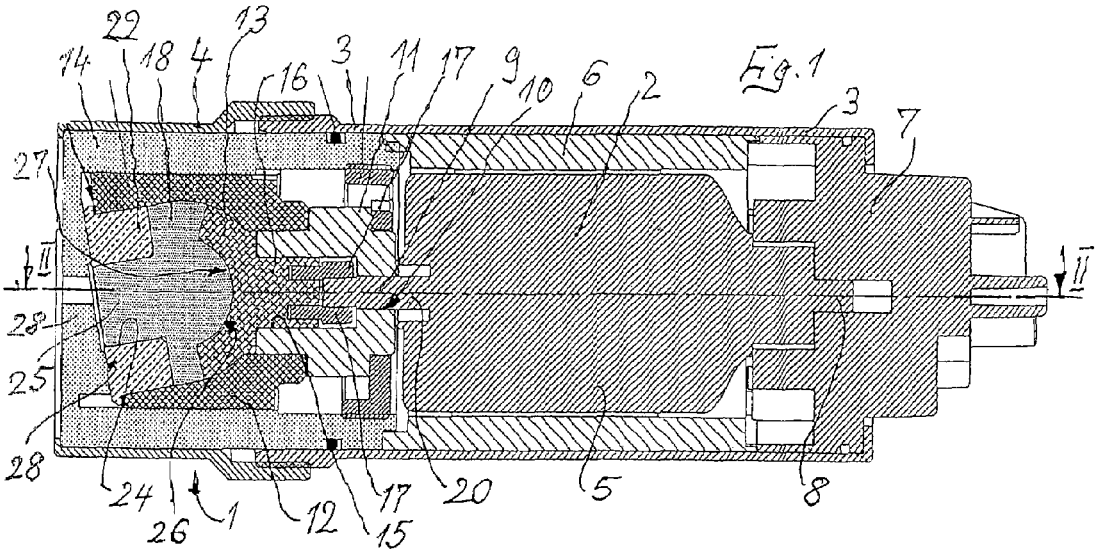
FIG. 1 is a longitudinal section, corresponding to the arrow 1 in FIG. 2, of a fuel delivery pump with inventive rotary piston machine.

The depicted fuel delivery pump has a rotary piston pump 1 and an electric motor 2 that drives the rotary piston pump 1, and these are arranged in a motor housing 3 and a housing cover 4 attached thereto. This is a highly simplified depiction of the electric motor with a rotor 5, a magnet ring 6, and an axial locking part 7 of the motor housing 3 that is connected and sealed thereto. In addition, a pivot bearing 8 of the rotor 5 is provided on this locking part 7. The fuel flows around the electric motor 5, 6 inside the motor housing 3 in order to cool it.

The second rotational bearing of the rotor 5 is provided at a shaft end 9 thereof in a bearing bore 10 of a bottom bearing 11 that is arranged in a corresponding opening on the end-face of a machine housing 12 of the rotary piston pump 1 and on which a driving part 13 with denticulation on the end-face can be supported. This machine housing 12 is arranged in a pump housing 14 that seals the motor housing 3 and is arranged partially therein and partially within the housing cover 4. The shaft end 9 projects into a bearing bore 15 that has a large diameter and that runs coaxial with the bearing bore 10 and in which a journal 16, inserted therein, of the driving part 13 is rotatably borne.

Figure 3:
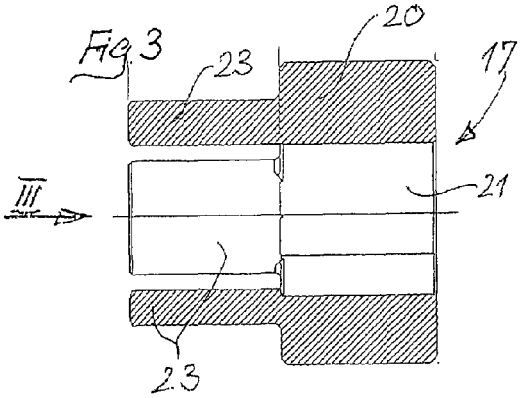
FIG. 3 is an enlargement of a longitudinal section of a catch coupling of the delivery pump; and, FIG. 4 is the axial view of this catch coupling corresponding to the arrow III in FIG. 3.
Figure 4:
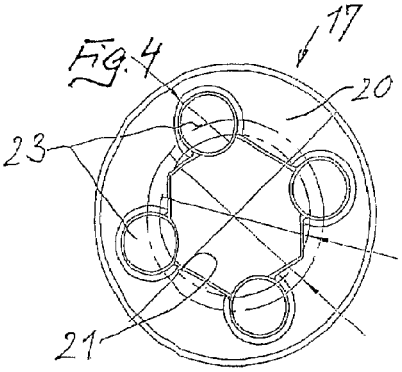

Arranged in the bearing bore 15, between the shaft end 9 of the electric motor 2 and the journal 16 of the driving part 13 is a catch coupling 17 as is shown enlarged in FIGS. 3 and 4. Since the shaft end 9 is borne in the bottom bearing 11 and also the driving part 13 with its journal 16, this catch coupling 17 should cause a certain clearance equalization, specifically in both the longitudinal and transverse directions. The bottom bearing 11 is embodied as a fixed bearing and is rigidly arranged between the machine housing 12, the pump housing 14, and the magnet ring 6.

Two pump rotors work in the machine housing 12, specifically a driven part 18 in addition to the driving part 13. The driving part 13 is driven by the shaft end 9 of the electric motor 2 and the catch coupling 17 and transmits its rotational movement to the driven part 18 through denticulation. Cycloid denticulation is provided on the end-faces of the driving part 13 and the driven part 18 and have corresponding working surfaces that face one another. As is shown in FIG. 2, this is how pump working spaces 19 are formed between these working surfaces and the inner wall of the machine housing 12.

As can be seen from FIGS. 3 and 4, the catch coupling 17 has an annular part 20 with a hexagonal interior recess 21 into which a corresponding hexagonal end section of the shaft end 9 of the electric motor 2 is inserted for the desired rotational connection and at the end face of which four insertion journals 23 are arranged that are inserted into corresponding openings arranged on the end-face of the journal 16.

An end-face opening in the machine housing 12 is closed on the driven side by a bottom bearing 22 that is arranged coaxially with the driven part 18. Arranged in this bottom bearing 22 is a bearing bore 24 in which the driven part 18 is borne via a journal 25 thereof. As cannot be seen from FIGS. 1 and 2, in addition the driving part 13 and the driven part 18 are loaded in opposition to one another by the hydraulic delivery pressure in which between the pump space on the pressure side and the sides of the driven/driving parts 13, 18 facing away from one another a connection is comprised via bores or channels. The driven part 18 is supported with a spherical elevation 26 on a corresponding spherical recess 27 of the driving part 13.

Figure 2:
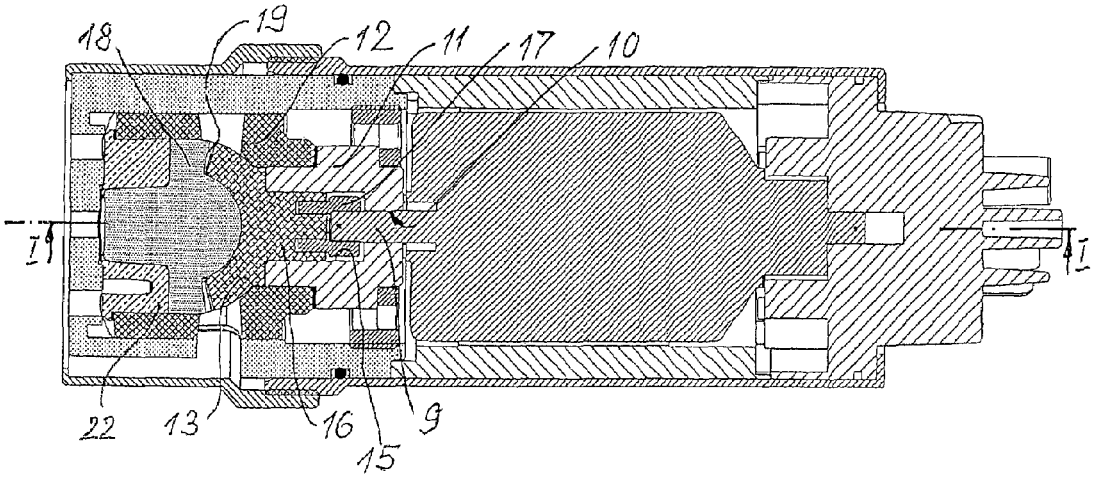
FIG. 2 is a longitudinal section through this delivery pump corresponding to the line II-II in FIG. 1.

As depicted in FIGS. 1 and 2, in special cases the pump housing 14 can be embodied in a pot shape, with a bottom 28 that correspondingly runs on an incline to the drive axis but at a right angle to the axis of the driven part 18 and on which the bottom bearing 22 of the driven part 18 is placed and supported. This advantageously provides an additional constructive decoupling of the pump side from the drive side, which can be of particular significance during servicing. All of the features depicted here can be essential to the invention individually and in any combination with one another.

LEGEND

1 Rotary piston pump
2 Electric motor
3 Motor housing
4 Housing cover
5 Rotor
6 Magnet ring
7 Locking part
8 Pivot bearing
9 Shaft end
10 Bearing bore
11 Bottom bearing
12 Machine housing
13 Driving part
14 Pump housing
15 Bearing bore
16 Journal (of 13)
17 Catch coupling
18 Driven part
19 Pump working spaces
20 Annular part
21 Interior recess
22 Bottom bearing
23 Insertion journal
24 Bearing bore
25 Journal
26 Elevation on 18
27 Recess on 13
28 Bottom

I claim:

1. A rotary piston machine, comprising:

at least two cooperating rotors including a driving part and a driven part that mutually create working spaces between confronting surfaces thereof and which have respective axes of rotation which enclose a certain angle to one another, said driving part and said driven part including a respective journal on a side thereof facing away from the working spaces formed therebetween;

a machine housing in which said driving part and said driven part are received, both said driving part and said driven part being borne with clearance in a direction of one another and being pivotably supported in respective bottom bearings that determine axial angular positions thereof and permit axial clearance therebetween, said respective bottom bearings of said driving part and said driven part being connected to said machine housing to create a unit, each of said respective bottom bearings including a radial edge area which is screwed, glued or pressed into a corresponding end-face opening in said machine housing for fixing said respective bottom bearings in said machine housing, said respective bottom bearings each including an annular central bore for receiving said respective journal;

a motor housing; and a drive device of said driving part, said drive device including an electric motor arranged in said motor housing, said machine housing and said motor housing being connected to one another.

2. A rotary piston machine according to claim 1, wherein said driving part and said driven part are loadable in opposition to one another by hydraulic delivery pressure delivered from said working spaces to respective sides of said driving part and said driven part facing away from one another.

3. A rotary piston machine according to claim 1, further comprising a clearance-equalizing catch coupling being arranged between a shaft end of said electric motor and said driving part.

4. A rotary piston machine according to claim 3, wherein said catch coupling includes an annular or plug-in part including a profiled interior recess for engaging said shaft end of said electric motor and further including an insertion journal for engaging in corresponding openings on a side of said driving part that faces away from said working spaces.

5. A rotary piston machine, comprising:

at least two cooperating rotors including a driving part and a driven part that mutually create working spaces between confronting surfaces thereof and which have respective axes of rotation which enclose a certain angle to one another;

a machine housing in which said driving part and said driven part are received, both said driving part and said driven part being borne with clearance in a direction of one another and being pivotably supported in respective bottom bearings that determine axial annular positions thereof and permit axial clearance therebetween, said respective bottom bearings of said driving part and said driven part being connected to said machine housing to create a unit;

a motor housing;

a drive device of said driving part, said drive device including an electric motor arranged in said motor housing, said machine housing and said motor housing being connected to one another; and a pump housing, said unit which is comprised of said machine housing being receivable in said pump housing, said pump housing being closable on an end-face facing away from said electric motor, said pump housing being configured in a shape of a pot including a bottom arranged on an incline to a center axis thereof for supporting a one of said bottom bearings corresponding to said driven part.

6. A rotary piston machine according to claim 5, wherein said driving part and said driven part are loadable in opposition to one another by hydraulic delivery pressure delivered from said working spaces to respective sides of said driving part and said driven part facing away from one another.

7. A rotary piston machine according to claim 5, further comprising a clearance-equalizing catch coupling being arranged between a shaft end of said electric motor and said driving part.

8. A rotary piston machine according to claim 7, wherein said catch coupling includes an annular or plug-in part including a profiled interior recess for engaging said shaft end of said electric motor and further including an insertion journal for engaging in corresponding openings on a side of said driving part that faces away from said working spaces.

* * * * *